US011065660B2

(12) United States Patent
Auzinger

(10) Patent No.: US 11,065,660 B2
(45) Date of Patent: Jul. 20, 2021

(54) PRODUCTION INSTALLATION HAVING A CLAMPING TOOL AND METHOD FOR ADAPTING A TOTAL LENGTH OF A BENDING EDGE OF THE CLAMPING TOOL

(71) Applicant: TRUMPF Maschinen Austria GmbH & Co. KG., Pasching (AT)

(72) Inventor: Michael Auzinger, Linz (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 224 days.

(21) Appl. No.: 16/461,873

(22) PCT Filed: Dec. 4, 2017

(86) PCT No.: PCT/AT2017/060322
§ 371 (c)(1),
(2) Date: May 17, 2019

(87) PCT Pub. No.: WO2018/102842
PCT Pub. Date: Jun. 14, 2018

(65) Prior Publication Data

US 2019/0366405 A1 Dec. 5, 2019

(30) Foreign Application Priority Data

Dec. 6, 2016 (AT) ..... A 51105/2016

(51) Int. Cl.
*B21D 5/04* (2006.01)

(52) U.S. Cl.
CPC ..... *B21D 5/047* (2013.01)

(58) Field of Classification Search
CPC .. B21D 5/0218; B21D 5/0227; B21D 5/0254; B21D 5/04; B21D 5/042; B21D 5/045; B21D 5/047; B21D 37/04
See application file for complete search history.

(56) References Cited

U.S. PATENT DOCUMENTS 4,532,792 A 8/1985 Hongo
4,660,402 A * 4/1987 Hongo ..... B21D 5/02 72/319

(Continued)

FOREIGN PATENT DOCUMENTS

CN 201625720 U 11/2010
DE 296 15 649 U1 10/1996

(Continued)

OTHER PUBLICATIONS

International Search Report in PCT/AT2017/060322, dated Apr. 4, 2018.

*Primary Examiner* — Edward T Tolan
(74) *Attorney, Agent, or Firm* — Collard & Roe, P.C.

(57) ABSTRACT

A production installation for producing workpieces from sheet metal by forming in a bending operation includes a bending machine and a clamping tool having at least one lower clamping jaw and an upper clamping jaw set including first upper clamping jaws and a second upper clamping jaw. The second upper clamping jaw has a clamping jaw part at each of the two second upper clamping jaw end sections, the clamping jaw parts being movable from a working to a pull-out position. At least one first upper clamping jaw is arranged on both sides of the second upper clamping jaw. The first upper clamping jaws have a first horn at each of the first end regions of the first upper clamping jaws facing away from the second upper clamping jaw. A method adapts a total length of a bending edge of a clamping jaw set of this production installation.

20 Claims, 5 Drawing Sheets

(56) References Cited

U.S. PATENT DOCUMENTS

| | | | | |
|---|---|---|---|---|
| 4,761,985 | A * | 8/1988 | Klingesberger | B21D 5/0236 72/316 |
| 5,313,814 | A * | 5/1994 | Yamamoto | B21D 5/047 72/319 |
| 5,474,437 | A | 12/1995 | Kuroyone | |
| 6,170,315 | B1 | 1/2001 | Codatto | |
| 6,227,028 | B1 * | 5/2001 | Jeandeaud | B21D 5/047 72/323 |
| 9,623,464 | B2 * | 4/2017 | Aigner | B21D 5/04 |

FOREIGN PATENT DOCUMENTS

| | | | |
|---|---|---|---|
| DE | 196 35 106 | A1 | 3/1998 |
| EP | 0 105 091 | A2 | 4/1984 |
| EP | 0 576 796 | A1 | 1/1994 |
| JP | H02-80122 | A | 3/1990 |
| JP | H05-212446 | A | 8/1993 |
| JP | 2000-343132 | A | 12/2000 |
| JP | 2005-212446 | A | 8/2005 |
| WO | 98/53929 | A1 | 12/1998 |
| WO | 2010/099559 | A1 | 9/2010 |

* cited by examiner

PRODUCTION INSTALLATION HAVING A CLAMPING TOOL AND METHOD FOR ADAPTING A TOTAL LENGTH OF A BENDING EDGE OF THE CLAMPING TOOL

CROSS REFERENCE TO RELATED APPLICATIONS

This application is the National Stage of PCT/AT2017/060322 filed on Dec. 4, 2017, which claims priority under 35 U.S.C. § 119 of Austrian Application No. A 51105/2016 filed on Dec. 6, 2016, the disclosure of which is incorporated by reference. The international application under POT article 21(2) was not published in English.

BACKGROUND OF THE INVENTION

1. Field of the Invention

The invention relates to a production installation for producing workpieces from sheet metal by means of forming in a bending operation, in particular by swivel bending or swing bending. However, the invention further also relates to a method for adapting a total length of a bending edge of a clamping jaw set of a production installation for producing workpieces from sheet metal by forming in a bending operation, in particular by swivel bending or swing bending.

2. Description of the Related Art

A generically formed bending machine became known from DE 196 35 106 A1. The bending machine comprises a bending wall as well as a first and a second clamping cheek for clamping a workpiece. One of the clamping cheeks comprises interchangeably arranged first and second clamping tool segments of a clamping tool set. A second clamping tool segment is respectively arranged on both sides of the clamping tool set, said second clamping tool segment comprising a sole portion adjustable relative to it from a clamping position to an entry position. The disadvantage of this is that for adapting the clamping length/the bending edge formed by the clamping tool set, individual ones of the first clamping tool segments, located between the two second clamping tool segments arranged on the outside, have to be removed from or added to the clamping tool set. This usually entails extensive retrofitting work.

A further generically formed bending machine became known from WO 98/53929 A1. The bending machine comprises a bending wall as well as a first and a second clamping cheek for clamping a workpiece. One of the clamping cheeks also comprises interchangeably arranged first and second clamping tool segments of a clamping tool set. The two clamping tool segments respectively arranged on the outside themselves respectively comprise a sole portion adjustable relative to their base body from a clamping position to an entry position. In this respect, it is again disadvantageous that for adapting the clamping length/the bending edge formed by the clamping tool set, individual ones of the first clamping tool segments, located between the two second clamping tool segments arranged on the outer sides, have to be removed from or added to the clamping tool set.

SUMMARY OF THE INVENTION

It was the object of the present invention to overcome the disadvantages of the prior art and to provide a production installation and a method, by means of which a user is capable of performing an easy and fast composition of clamping jaw sets for different bending requirements.

This object is achieved by means of a production installation and a method according to the claims.

The production installation according to the invention serves for producing workpieces from sheet metal by means of forming in a bending operation, in particular by swivel bending or swing bending. The production installation may comprise at least the following installation parts or components:

- a bending machine with a fixed machine frame, a lower clamping beam and with an upper clamping beam, wherein at least one of the clamping beams is adjustable relative to the machine frame in order to clampingly hold the workpiece to be manufactured,
- a clamping tool with at least one lower clamping jaw and with an upper clamping jaw set from several first upper clamping jaws and at least one second upper clamping jaw. Each of the clamping jaws comprises a base body, wherein the at least one lower clamping jaw is held on the lower clamping beam and the upper clamping jaws of the upper clamping jaw set are held on the upper clamping beam. The at least one second upper clamping jaw in the direction of the longitudinal extension of the clamping beams on a first end section comprises a first clamping jaw part movable relative to its base body from a working position to a pull-out position, wherein the longitudinal dimension of the upper clamping jaw set is shorter in the pull-out position than in the working position, and
- wherein a bending edge aligned in the direction of the longitudinal extension of the clamping beams is formed by the upper clamping jaw set when the upper clamping jaws are in the working position, and a first partial bending edge of the bending edge is respectively formed by each first upper clamping jaw as well as a second partial bending edge is formed by the at least one second upper clamping jaw in the working position, and
- a bending unit, said bending unit being adjustable relative to the clamping tool for performing a bending operation, and
- that the at least one second upper clamping jaw further comprises a second clamping jaw part movable from the working position in the pull-out position on its second end section arranged at a distance from the first end section in the direction of the longitudinal extension of the clamping beams, and
- that at least one first upper clamping jaw is respectively arranged on both sides of the at least one second upper clamping jaw in the direction of the longitudinal extension of the clamping beams, and
- that the first upper clamping jaws respectively comprise a first horn at least on their first end regions facing away from the at least one second upper clamping jaw, said first horn being formed to project from the respective base body of the first upper clamping jaw in the direction of the longitudinal extension of the clamping beams.

The advantage achieved thereby is that by providing clamping jaw parts movable relative to the base body from the working position to the pull-out position on both sides, a free adjusting space may be created between the first upper clamping jaws respectively arranged on both sides thereof and the second upper clamping jaws arranged between these. It hence becomes possible to easily and quickly adjust the clamping length of the upper tool set to different application requirements. As the first upper clamping jaws are also respectively provided with an additional horn on the outside of the clamping jaw set, the clamping length/the total length of the bending edge to be formed may be provided by simple lateral adding or removing of first upper clamping jaws. The second clamping jaw always remains in an unchanged position in relation to the clamping beam. Prior to the beginning of the clamping operation of the workpiece to be manufactured, the upper clamping jaw set is to be moved to its shortened pull-out position and also prior to the beginning of the clamping operation, it is to be adjusted to the working position elongated for this purpose within the workpiece to be manufactured. For this purpose, the first upper clamping jaws in vicinity to the second upper clamping jaw are to be adjusted to be so far from it that the relatively movable clamping jaw parts may be moved from their shortened pull-out position into the working position comprising a larger longitudinal dimension for this purpose. The adjustment movement to be carried out in the direction of the longitudinal extension of the bending beams may for example be performed by a sliding movement. When the upper clamping jaw set is located in its working position, the individual upper clamping jaws may be held on the clamping beam positioned stationarily and the clamping operation of the workpiece to be manufactured may be carried out. Once the clamping of the workpiece has been carried out, the bending operation may be started. Hence, sufficiency may be achieved by means of shortest adjustment movements carried out centrally with respect to the second clamping jaw.

It may further be advantageous if the clamping jaw parts are respectively formed with a horn-shaped projection, and a shortened outer longitudinal dimension of the second upper clamping jaw in the direction of the longitudinal extension of the clamping beams is defined by the clamping jaw parts in the pull-out position. Thereby, a protrusion of the clamping jaw parts in the direction of the longitudinal extension of the clamping beam in the working position may be achieved easily. By means of the relative movement of the clamping jaw parts, the horn-shaped projection may respectively be moved within the contour of the base body so far that a free adjusting space may be created on both sides of the second upper clamping jaw.

Another embodiment is characterized in that the shortened outer longitudinal dimension of the second upper clamping jaw in the pull-out position corresponds to a maximum length of the base body of the second upper clamping jaw. It hence becomes possible to place the first upper clamping jaws respectively located on both sides of the second upper clamping jaw directly on the base body of the second upper clamping jaw for achieving a maximum adjustment track.

A further possible embodiment has the features that in the pull-out position, the first upper clamping jaws that are respectively arranged on both sides of the at least one second upper clamping jaw are respectively moved in the direction of the base body of the at least one second upper clamping jaw. Hence, the free space towards the workpiece, in particular its undercut, required for the pull-out operation may be created in the outer edge region of the clamping jaw set.

In a further embodiment, it is provided for that at least individual ones of the first upper clamping jaws respectively comprise a second horn projecting from the base body in the direction of the longitudinal extension of the clamping beams on their second end regions facing the at least one second upper clamping jaw. Thus, a universal use of the first upper clamping jaws may be achieved. Consequently, the provision of left and right realizations may be refrained from, as thus formed first upper clamping jaws may be used both on the left side and on the right side of the second upper clamping jaw.

Another embodiment is characterized in that the at least one second upper clamping jaw of the upper clamping jaw set is arranged on a stationary position in relation to the upper clamping beam. By means of the stationary positioning of the second upper clamping jaw, the energy supply of the latter for adjusting the relatively movable clamping jaw parts may also easily be provided in a stationarily positioned manner.

A further preferred embodiment is characterized in that the at least one second upper clamping jaw is arranged in a central region of the upper clamping jaw set. Thus, a symmetrical arrangement of the first upper clamping jaws arranged on both sides of the second upper clamping jaw may be effected.

It may further be advantageous if the number of upper clamping jaws of the upper clamping jaw set is selected such that in the working position, a total length of the bending edge corresponds to a sum, said sum being composed of the individual lengths of the first partial bending edges of the first upper clamping jaws plus the length of the second partial bending edge of the second upper clamping jaw, and the thus composed sum at the maximum corresponds to a longitudinal dimension of the clamping length to be supported on the workpiece to be manufactured. Thus, a nearly or entirely continuous clamping length and in further consequence a nearly continuous bending edge may be provided for the bending operation to be carried out.

Another alternative embodiment is characterized in that the numbers of upper clamping jaws of the upper clamping jaw set in the working position and in the pull-out position are equal to one another. Thereby, additional manipulation operations, such as adding or removing individual ones of the clamping jaws, may be prevented. Moreover, a faster change between the working position and the pull-out position may be achieved thereby.

A further possible and possibly alternative embodiment has the features that the clamping tool further comprises a lower clamping jaw set and the lower clamping jaw set comprises several first lower clamping jaws and at least one second lower clamping jaw, and that the at least one second lower clamping jaw respectively comprises a first and second clamping jaw part movable from the working position in the pull-out position on both sides on its first and second end sections arranged in the direction of the longitudinal extension of the clamping beams. This allows for a customized adaption to different bending operations being carried out easily also in the region of the lower clamping jaw set.

In another embodiment, it is provided for that at least one first lower clamping jaw is respectively arranged on both sides of the at least one second lower clamping jaw in the direction of the longitudinal extension of the clamping beams. Thereby, in turn, a central arrangement of the second lower clamping jaw between the first lower clamping jaws arranged thereon on both sides respectively may be created.

However, irrespective of this, the object of the invention may also be achieved by a method for adapting a total length of a bending edge of a clamping jaw set of a clamping tool of a production installation for producing workpieces from sheet metal by forming in a bending operation, in particular by swivel bending or swing bending, if at least the following steps are carried out:

providing a clamping tool comprising at least one lower clamping jaw and an upper clamping jaw set with several first upper clamping jaws and with at least one second upper clamping jaw, wherein each of the clamping jaws comprises a base body. The at least one lower clamping jaw is held on the lower clamping beam and the upper clamping jaws of the upper clamping jaw set are held on the upper clamping beam. The at least one second upper clamping jaw in the direction of the longitudinal extension of the clamping beams on a first end section comprises a first clamping jaw part movable relative to its base body from a working position to a pull-out position, wherein the longitudinal dimension of the upper clamping jaw set is formed to be shorter in the pull-out position than in the working position, and wherein a bending edge aligned in the direction of the longitudinal extension of the clamping beams is formed by the upper clamping jaw set when the upper clamping jaws are in the working position. A first partial bending edge of the bending edge is respectively formed by each first upper clamping jaw as well as a second partial bending edge is formed by the at least one second upper clamping jaw in the working position, and providing a bending unit, said bending unit being adjustable relative to the clamping tool for performing a bending operation, and that the at least one second upper clamping jaw is further provided with a second clamping jaw part movable from the working position in the pull-out position on its second end section arranged at a distance from the first end section in the direction of the longitudinal extension of the clamping beams, and that at least one first upper clamping jaw is respectively arranged on both sides of the at least one second upper clamping jaw in the direction of the longitudinal extension of the clamping beams, and that the first upper clamping jaws are respectively provided with a first horn at least on their first end regions facing away from the at least one second upper clamping jaw, said first horn being formed to project from the base body of the first upper clamping jaw in the direction of the longitudinal extension of the clamping beams.

The advantage of the method steps selected here is that by providing clamping jaw parts movable relative to the base body from the working position to the pull-out position on both sides, a free adjusting space may be created between the first upper clamping jaws respectively arranged on both sides thereof and the second upper clamping jaws arranged between these. It hence becomes possible to easily and quickly adjust the clamping length of the upper tool set to different application requirements. As the first upper clamping jaws are also respectively provided with an additional horn on the outside of the clamping jaw set, the clamping length/the total length of the bending edge to be formed may be provided by simple lateral adding or removing of first upper clamping jaws. The second clamping jaw always remains in an unchanged position in relation to the clamping beam. Prior to the beginning of the clamping operation of the workpiece to be manufactured, the upper clamping jaw set is to be moved to its shortened pull-out position and also prior to the beginning of the clamping operation, it is to be adjusted to the working position elongated for this purpose within the workpiece to be manufactured. For this purpose, the first upper clamping jaws in vicinity to the second upper clamping jaw are to be adjusted to be so far from it that the relatively movable clamping jaw parts may be moved from their shortened pull-out position into the working position comprising a larger longitudinal dimension for this purpose. The adjustment movement to be carried out in the direction of the longitudinal extension of the bending beam may for example be performed by a sliding movement. When the upper clamping jaw set is located in its working position, the individual upper clamping jaws may be held on the clamping beam positioned stationarily and the clamping operation of the workpiece to be manufactured may be carried out. Once the clamping of the workpiece has been carried out, the bending operation may be started. Hence, sufficiency may be achieved by means of shortest adjustment movements carried out centrally with respect to the second clamping jaw.

Furthermore, an approach is advantageous in which the clamping jaw parts are respectively formed with a horn-shaped projection, and a shortened outer longitudinal dimension of the second upper clamping jaw in the direction of the longitudinal extension of the clamping beams is defined by the clamping jaw parts in the pull-out position. Thereby, a protrusion of the clamping jaw parts in the direction of the longitudinal extension of the clamping beam in the working position may be achieved easily. By means of the relative movement of the clamping jaw parts, the horn-shaped projection may respectively be moved within the contour of the base body so far that a free adjusting space may be created on both sides of the second upper clamping jaw.

A further advantageous approach is characterized in that the shortened outer longitudinal dimension of the second upper clamping jaw in the pull-out position corresponds to a maximum length of the base body of the second upper clamping jaw. It hence becomes possible to place the first upper clamping jaws respectively located on both sides of the second upper clamping jaw directly on the base body of the second upper clamping jaw for achieving a maximum adjustment track.

A method variant, in which for the formation of the pull-out position, the first upper clamping jaws that are respectively arranged on both sides of the at least one second upper clamping jaw are respectively moved in the direction of the base body of the at least one second upper clamping jaw, is also advantageous. Hence, the free space towards the workpiece, in particular its undercut, required for the pull-out operation may be created in the outer edge region of the clamping jaw set.

Another approach is characterized in that at least individual ones of the first upper clamping jaws respectively comprise a second horn projecting from the base body in the direction of the longitudinal extension of the clamping beams on their second end regions facing the at least one second upper clamping jaw. Thus, a universal use of the first upper clamping jaws may be achieved. Consequently, the provision of left and right realizations may be refrained from, as thus formed first upper clamping jaws may be used both on the left side and on the right side of the second upper clamping jaw.

Furthermore, an approach in which the at least one second upper clamping jaw of the upper clamping jaw set is arranged on a stationary position in relation to the upper clamping beam, is also advantageous. By means of the stationary positioning of the second upper clamping jaw, the energy supply of the latter for adjusting the relatively movable clamping jaw parts may also easily be provided in a stationarily positioned manner.

A further advantageous approach is characterized in that the number of upper clamping jaws of the upper clamping jaw set is selected such that in the working position, a total length of the bending edge corresponds to a sum, said sum being composed of the individual lengths of the first partial bending edges of the first upper clamping jaws plus the length of the second partial bending edge of the second upper clamping jaw, and the thus composed sum at the maximum corresponds to a longitudinal dimension of the clamping length to be supported on the workpiece to be manufactured. Thus, a nearly or entirely continuous clamping length and in further consequence a nearly continuous bending edge may be provided for the bending operation to be carried out.

BRIEF DESCRIPTION OF THE DRAWINGS

For the purpose of better understanding of the invention, it will be elucidated in more detail by means of the figures below.

These show in a respectively very simplified schematic representation.

DETAILED DESCRIPTION OF THE PREFERRED EMBODIMENTS

First of all, it is to be noted that in the different embodiments described, equal parts are provided with equal reference numbers/equal component designations, where the disclosures contained in the entire description may be analogously transferred to equal parts with equal reference numbers/equal component designations. Moreover, the specifications of location, such as at the top, at the bottom, at the side, chosen in the description refer to the directly described and depicted figure and in case of a change of position, these specifications of location are to be analogously transferred to the new position.

The term "particularly/in particular" is hereinafter understood such that it may refer to a possible, more specific embodiment and more detailed specification of a subject matter or a method step, but does not necessarily have to represent an obligatory, preferred embodiment of the latter or an approach.

FIGS. 1 through 5 show a production installation 1 with its parts and components, wherein an overview of the production installation 1 can be gathered from individual figures and details of the latter are shown more closely in other figures.

Figure 1:
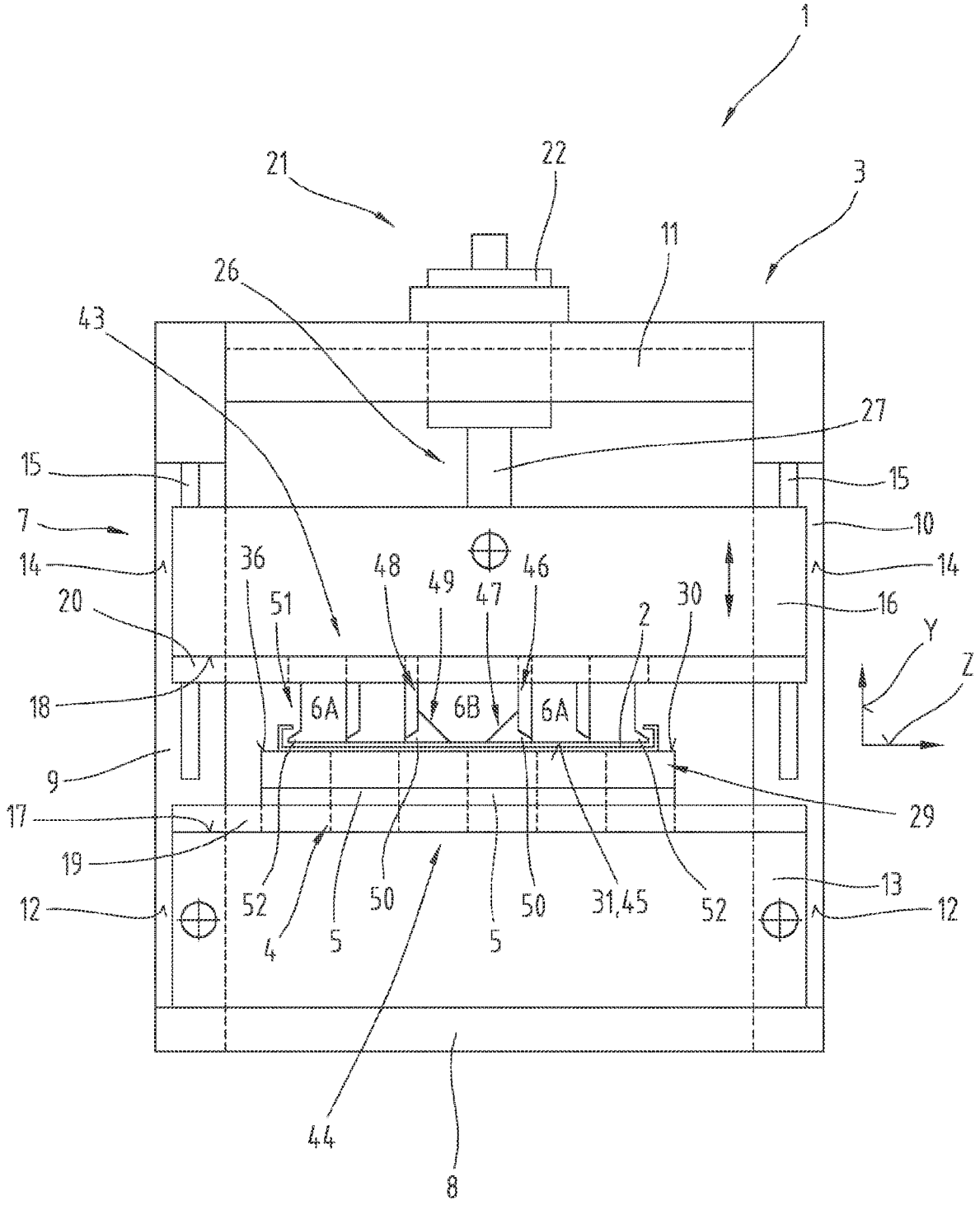
FIG. 1 a front view of a production installation with a bending machine as well as removed support table and removed manipulation apparatus.
Figure 2:
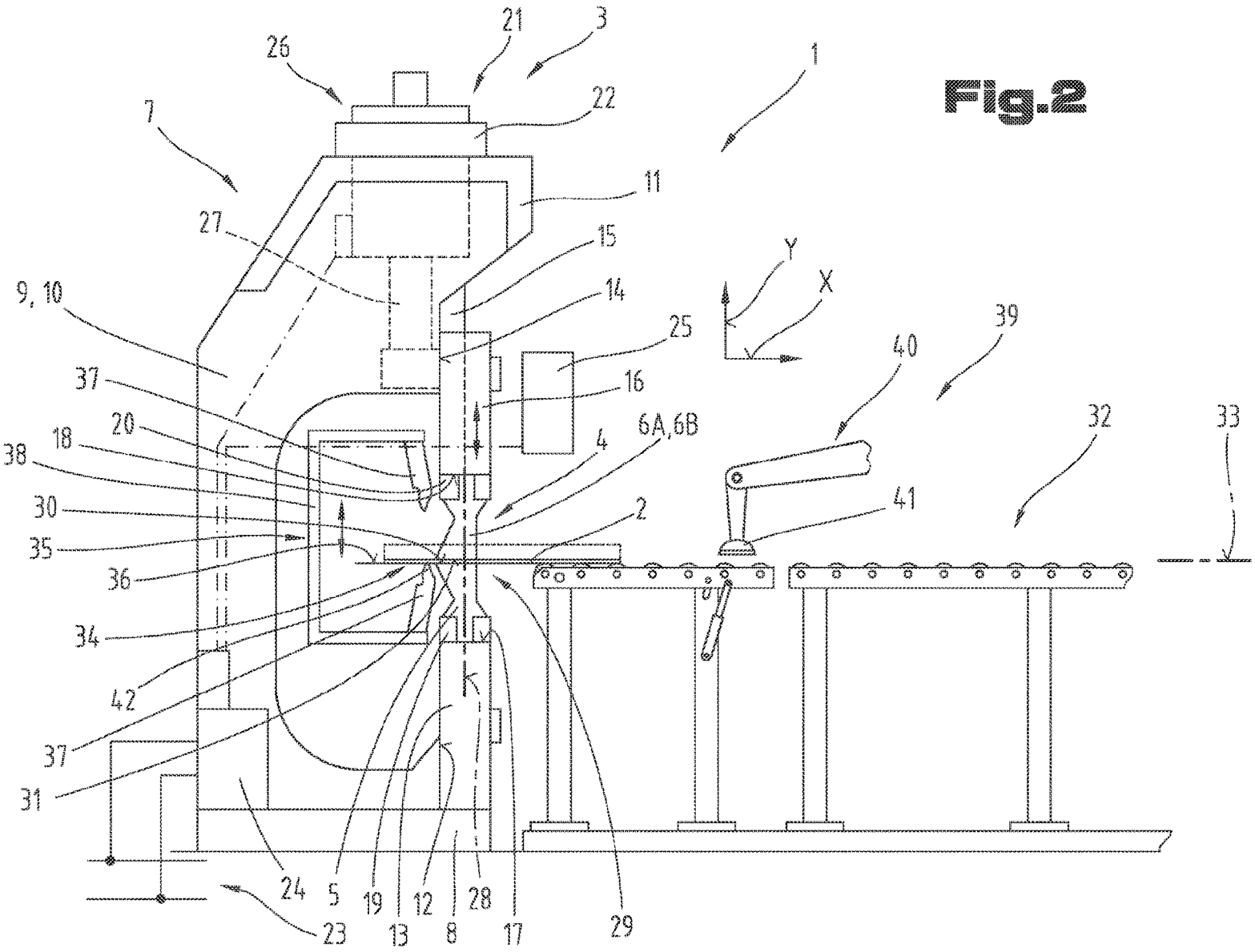
FIG. 2 a lateral view of the production installation according to FIG. 1 with support table and manipulation apparatus.

FIGS. 1 and 2 show a very simplified schematic representation of a production installation 1, which is in particular designed for swivel bending or swing bending workpieces 2 to be manufactured from sheet metal in the present case. Usually, a metallic material, which may be referred to as flats/panel in its undeformed state, is used as a source material. During swivel bending or swing bending, the sheet metal to be processed or the workpiece 2 to be manufactured is clampingly held by means of clamping jaws 5, 6 and bended by means of a separate bending unit 35 with a bending tool 37 briefly described below.

In order to clampingly hold the sheet metal to be processed or the workpiece 2 to be manufactured, which comprises an undercut on at least one end of the bending region, it may be required that partial sections of the clamping jaws 5, 6 are formed adjustably or to adjustably hold or mount at least one individual clamping jaw 5, 6 itself. In order to move the preferably upper clamping jaw 6 into a lateral undercut located in the region of the clamping jaws 5, 6 and subsequently move it back out of the undercut, at least individual ones of the clamping jaws 5, 6 are equipped with an adjustable clamping jaw part, as will be described in more detail below. The workpiece 2 with its left-sided and right-sided undercuts is shown in a simplified manner in FIG. 1.

The production installation 1 described in more detail and used for bending in the present case comprises a bending machine 3, in particular a swivel bending machine, designed to clampingly hold the workpiece 2 or workpieces to be manufactured from the sheet metal between a clamping tool 4 adjustable relative to one another. In the present exemplary embodiment, the clamping tool 4 comprises at least one lower clamping jaw 5, however, usually preferably several lower clamping jaws 5, and at least one upper clamping jaw 6, however, usually preferably several upper clamping jaws 6 interoperating with it. The lower clamping jaw or the lower clamping jaws 5 may also be referred to as a part of the lower jaw and the upper clamping jaw 6 or the upper clamping jaws 6 may also be referred to as a part of the upper jaw. Furthermore, it is also possible that the lower clamping jaw 5 is continuously formed from one piece.

In a coordinate system for such a bending machine 3, the "x" direction is generally referred to as the direction extending in perpendicular orientation in a horizontal plane with respect to the longitudinal extension of the clamping jaws 5, 6. Thus, this is the direction which corresponds to the feed direction or the removal direction. The "y" direction is understood as the vertical direction which thus extends in the height direction of the clamping jaws 5, 6 and further in vertical direction with respect to the horizontal plane. Lastly, the "z" direction is understood as the direction into which the longitudinal direction/the direction of the longitudinal extension of the clamping jaws 5, 6 extends. Thus, the longitudinal extension of a bending edge 45 later defined by at least one of the clamping jaws 5, 6 is also directed into the "z" direction.

As may better be gathered from FIG. 1, several upper clamping jaws 6 are provided, wherein for these, are further differentiation is made between a first upper clamping jaw 6A and at least one second upper clamping jaw 6B. At least two, but preferably several, first upper clamping jaws 6A are provided, which are respectively arranged on opposite sides with respect to the second upper clamping jaw 6B. The oppositely arranged sides refer to the longitudinal extension of the second upper clamping jaw 6B in "z" direction.

At this, the at least one upper clamping jaw 6 is arranged above the workpiece 2 to be manufactured on the bending machine 3 and is held, in particular clamped, there correspondingly. The at least one lower clamping jaw 5 is also held, in particular clamped, on the bending machine 3.

A machine frame 7 of the bending machine 3 for example comprises side walls 9, 10 rising from a base plate 8 vertically, having a distance from one another and being arranged in parallel to one another. These are preferably connected to one another by a massive cross connection 11 for example formed of a sheet metal preform on their end regions distanced from the base plate 8. The machine frame 7 usually is a solid component of the bending machine 3 preferably fixed on an even hall floor. The presently shown form was selected merely by way of example of a plurality of other possible designs.

The side walls 9, 10 may preferably be formed approximately in a C-shape for the formation of a free space for forming the workpiece 2, wherein a fixed lower clamping beam 13, particularly standing on the base plate 8, is mounted to front end faces 12 of near-base limbs of the side walls 9, 10. This preferably stationarily arranged and fixed lower clamping beam 13 may also be referred to as clamping table or as lower cheek, which the parts of the clamping tool 4 are arranged on and also held on.

On front end faces 14, an upper clamping beam 16, in particular a pressure beam, adjustable relative to the lower clamping beam 13 is mounted in a guided manner on limbs distanced from the base plate 8 in clamping beam guides 15. The clamping beam guides 15 are usually formed as linear guides in most diverse embodiments. The upper clamping beam 16 may also be referred to as upper cheek, which is, however, guided on it movably relative to the machine frame 7. On end faces 17, 18 opposing one another, facing one another and extending in parallel to one another of the two clamping beams 13, 16, clamping jaw mounts 19, 20 for equipping with the clamping tool 4 or the clamping tools 4 may be arranged. The clamping tool(s) 4 may also may also be held on the clamping jaw mounts 19, 20 with interposition of an adapter which is not represent in more detail herein. It is further possible to clampingly hold at least individual ones of the clamping jaws 5, 6 movable relative to the respective clamping beams 13, 16 on these in "z" direction and in a predetermined position.

The shown bending machine 3 comprises at least one driving means 22 preferably using electric energy, which may be line-connected with a controller 24 supplied from an energy grid 23, as a driving arrangement 21 for the adjustable upper clamping beam 16, namely the pressure beam. The operation of the bending machine 3 may for example be controlled via an input terminal 25 line-connected with the controller 24.

The driving means 22 are preferably electro-motor driven spindle drives 26, as are generally known, by means of which adjusting means 27 for a reversible adjusting movement of the upper clamping beam 16 formed by the pressure beam are for example drive-connected to it. However, other driving means 22 known from the prior art, such as cylinder-piston arrangements, stepper motors, rack and pinion drives or the like, may also be used.

Further details required for the operation of such a bending machine 3, such as safety installations, stopping arrangements and/or control devices, are not addressed in the present description so as to avoid an unnecessary length of the description.

Moreover, it is represented here in a simplified manner that the two clamping beams 13, 16, in particular their tool holders 19, 20, or the clamping tool 4 held thereon with its lower and upper clamping jaw(s) 5, 6, when looked at in the longitudinal direction of the clamping beams 13, 16, define an adjusting plane or a machine plane 28 extending therebetween. The adjusting plane or the machine plane 28 preferably extends centrally in relation to the clamping beams 13, 16/the clamping jaw mounts 19, 20 arranged on these. In the present exemplary embodiment, here, a vertically directed plane is meant. The adjusting plane or the machine plane 28 may also be referred to as reference plane for the bending tool 37 located in its vertical orientation. However, in further consequence the machine plane 28 may also form a reference plane for a bending tool 37 of a bending unit 35.

The two clamping jaws 5, 6 form a clamping region 29 between them on ends respectively facing one another. Lower and upper clamping surfaces 30, 31 facing one another of the two clamping jaws 5, 6 are preferably oriented at right angles relative to the adjusting plane or the machine plane 28. These clamping surfaces 30, 31 serve the purpose of holding the sheet metal positioned stationarily between the two clamping jaws 5, 6 according to its wall thickness for performing the bending operation.

An additional support table 32 with its support surface defining a support plane 33 may preferably be arranged in the region of the front side of the bending machine 3, which is merely shown in FIG. 2 in a simplified manner. The support table 32 may be provided, however, it does not obligatorily have to be present.

The support plane 33 may also be referred to as supporting plane. In this respect, it is to be noted that the support surface does not have to be formed over the entire surface, but may also be formed of several partial support surfaces arranged next to one another and/or behind one another in the feed direction of the sheet metal to be processed. The support surface 33 defined by the support plane preferably is arranged on the same plane as the lower clamping surface 30 of the at least one lower clamping jaw 5. It may serve as an additional support in the feed region of the bending machine 3 for more large-scale sheet metal, in order to prevent unintended kinking in particular of thinner sheet metal.

A bending region 34 is referred to as the region which serves for forming the workpiece 2 to be manufactured from the usually planar still undeformed sheet metal or further processing an already preformed workpiece 2, by at least one additional bevel or bend being formed.

The bending region 34 is usually located at a distance from the machine plane 28 of the clamping beams 13, 16 and is formed by end sections facing one another of at least one clamping jaw 5, 6, however, preferably of both clamping jaws 5, 6. In the present exemplary embodiment, the bending region 34 is arranged on a side of the clamping beams 13, 16 facing away from the support table 32 or from an operating person not shown in further detail. Thus, the bending region 34 is arranged extending within the machine frame 7.

The bending region 34 usually forms a preferably straight bending line on the workpiece 2 to be manufactured, wherein limbs respectively form on both sides of the bending region 34 in consequence of the performed bending operation. One of the limbs of the workpiece 2 is held in clamping position between the two clamping surfaces 30, 31 of the clamping jaws 5, 6, wherein the at least one further limb is located outside of the clamping surfaces 30, 31. Depending on the desired geometry/the geometry that is to be manufactured of the workpiece 2, the two limbs form a bending angle between one another. This bending angle is measured in a reference plane that is vertical in relation to the bending line. The reference plane, in turn, is preferably also oriented extending in vertical direction in relation to the machine plane 28.

In this respect, it is to be noted that the machine frame 7 of the bending machine 3 is merely represented in a very simplified manner, it also being possible to use embodiments deviating from this. For example, the machine frame 7/the machine body could be formed with a free upright passage. In this case the clamping jaw mounts 19, 20 could be mounted between the side walls 9, 10/side parts. In another embodiment of the machine frame 7/the machine body, it is not possible to have a free upright passage, whereby the clamping jaw mounts 19, 20 cannot be mounted between the side walls 9, 10/side parts.

For performing the bending operation, the bending machine 3 of the production installation 1 also comprises a bending unit 35, which may also be referred to as a bevel unit or forming unit. The latter is shown in a simplified form in FIG. 2 and may be adjusted relative to the machine frame 7 according to the bending operation to be performed. To provide a better overview, representation of the bending unit 35 and its components in FIG. 1 was abstained from.

The metal sheet which is prepositioned and clampingly held between the clamping jaws 5, 6 may be formed, in particular bent, to form the workpiece 2 by means of a bending operation, in particular folding a surface part in relation to the remaining surface part, along the bending line forming the bending region 34.

Depending on the bending or beveling to be performed on the metal sheet clampingly held between the clamping jaws 5, 6 to manufacture the workpiece 2, either the lower clamping jaw 5 or the at least one upper clamping jaw 6 forms the beveling region and thus the bending region 34. Thus, the at least one lower clamping jaw 5 forms a first forming edge or comprises the latter. T at least one upper clamping jaw 6 forms a second forming edge or comprises the latter.

The two clamping surfaces 30, 31 of the clamping jaws 5, 6 described above define a workpiece supporting plane 36 for the workpiece 2 to be manufactured in a position resting against one another. Preferably, the workpiece supporting plane 36, looked at in a vertical direction, is arranged at the same height as the support plane 33 defined by the support table 32. The two planes are preferably oriented extending plane-parallel to one another and arranged in a common plane.

The bending unit 35 may comprise one or several bending tool(s) 37, arranged on a tool carrier not specified further of a bending beam 38, in particular be held thereon. The bending beam 38 may be adjustable on bending beam guides, not represented in further detail, by means of a bending beam drive relative to the machine frame 7, as indicated by a double arrow in FIG. 2. In the present exemplar embodiment, the main adjustment direction of the bending beam 38 extends in vertical direction and predominantly parallel in relation to the machine plane 28 oriented to extend vertically. This corresponds to a movement in the direction of the "y" direction described above. In addition to this, a minimal adjustment of the bending tool 37 by means of the bending beam 38 towards the direction of the clamping jaws 5, 6, corresponding to an adjustment in the "x" direction, may be carried out at the end of the bending operation. Hence, a slight overbending may be achieved, whereby the correct bending angle may be observed after unloading due to the rebound.

Furthermore, the production installation 1 may also comprise a manipulation apparatus 39 with at least one manipulator 40 shown in simplified form for the common manipulation of the metal sheet or the workpiece 2 to be manufactured in the front/operating region of the bending machine 3. The manipulation of the sheet metal or the workpiece 2 to be manufactured from it is carried out in the region of the support table 32, preferably by the manipulator 40, of which merely a first holding element 41 on a part of a manipulator arm is shown. The first holding element 41 or the first holding elements 41 may for example be formed as suction element and/or magnet, by means of which the sheet metal may be held on its side facing away from the support plane 33 of the support table 32 and in further consequence moved relative to the clamping tool 4 and oriented to be positioned in relation to the bending region 34. However, it would also be possible to form the first holding element 41 as a gripper with interoperating gripping fingers and, if applicable, to dispense with the support table 32.

Depending on the bending direction of the sheet metal to be performed, either the lower bending tool 37 or the upper bending tool 37 respectively form a working edge 42 in conjunction with the at least one lower clamping jaw 5 or with the at least one upper clamping jaw 6.

In FIG. 1, it is further shown in simplified form that in "z" direction, several upper clamping jaws are arranged adjacent to one another and may generally be held adjustably in "z" direction in the upper clamping jaw mount. The adjustment is preferably carried out in the direction of the longitudinal extension of the bending region. The relative longitudinal adjustment of at least individual ones of the upper clamping jaws may take place or be carried out by means of a separate adjustment arrangement, which is, however, not shown in further detail, and/or by means of the manipulator. In this respect, it is to be noted that the embodiment of an upper clamping jaw set from several upper clamping jaws and at least one second upper clamping jaw described in more detail below applies analogously to a lower clamping jaw set with several lower clamping jaws. Either merely the upper clamping jaw set or merely the lower clamping jaw set may be formed this way. However, it would also be possible to form both the upper clamping jaw set and the lower clamping jaw set according to one of the embodiments described in more detail below.

Each of the individual clamping jaws 5, 6 comprises a base body not designated in further detail. Each of the base bodies may be formed so as to or serve the purpose of being held on and mounted to one of the clamping beams 13, 16, as sufficiently known from the general prior art.

In this embodiment, it is further indicated that the at least one second upper clamping jaw 6B in the direction of the longitudinal extension of the clamping beams 13, 16 on its first end section 46 comprises a first clamping jaw part 47 movable relative to its base body from a working position to a pull-out position. Moreover, the at least one second upper clamping jaw 6B may comprise a second clamping jaw part 49 also movable from the working position in the pull-out position on its second end section 48 arranged at a distance from the first end section 46 in the direction of the longitudinal extension of the clamping beams 13, 16.

The clamping jaw parts 47, 49 of the second upper clamping jaw 6B are respectively formed with a horn-shaped projection 50. Each of the projections 50 projects from the base body to the respective side/direction facing away from the base body of the second upper clamping jaw 6B in the working position as a horn. When the clamping jaw parts 47, 49 are in the pull-out position, a shortened outer longitudinal dimension of the second upper clamping jaw 6B is formed in the direction of the longitudinal extension of the clamping beams 13, 16. Preferably, the shortened outer longitudinal dimension in the pull-out position corresponds to a length of the base body of the second upper clamping jaw 6B. Hence, lateral jutting out of the clamping jaw parts 47, 49 over the base body may be prevented.

Moreover, at least one first upper clamping jaw 6A is respectively arranged on both sides of the at least one second upper clamping jaw 6B in the direction of the longitudinal extension of the clamping beams 13, 16. In order to the take the first upper clamping jaws 6A respectively located on the outside in the direction of the longitudinal extension into the undercut of the workpiece 2 described above for the clamping hold, the first upper clamping jaws 6A respectively comprise a first horn 52 at least on their first end regions 51 facing away from the at least one second upper clamping jaw 6B. Each of the first horns 52 is formed to project from the respective base body of the second upper clamping jaw 6A in the direction of the longitudinal extension of the clamping beams 13, 16.

In the pull-out position, the entire longitudinal dimension of the upper clamping jaw set 43 is shorter than in the working position. Hence, in the working position, a sufficient clamping effect as well as the bending edge 45 may be formed also in the region of the at least one undercut formed by the workpiece 2.

The entire bending edge 45 of the upper clamping jaw set 43 is formed by the upper clamping jaws 6A, 6B in the direction of the longitudinal extension of the clamping beams 13, 16 in the working position. Preferably, an aligned, continuously formed bending edge 45 is selected. Thus, a first partial bending edge 53 is formed by each of the first upper clamping jaws 6A respectively. Moreover, a second partial bending edge 54 is formed by a second upper clamping jaw 6B in the working position. The longitudinal dimension of the second partial bending edge 54 is composed of partial lengths of the clamping jaw parts 47, 49 as well as the partial length of a base body of the at least one second upper clamping jaw 6B.

Figure 3:
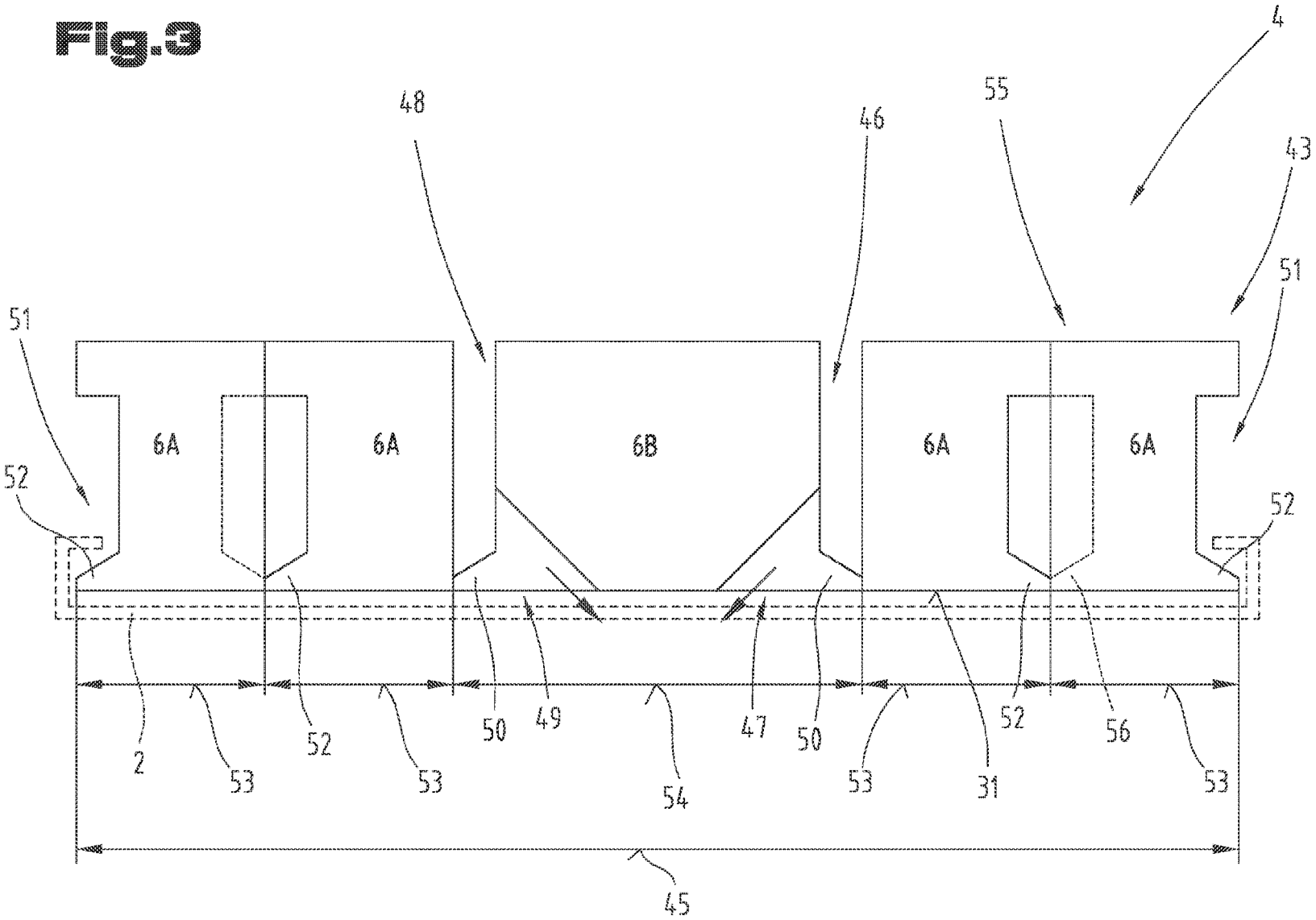
FIG. 3 a front view of an upper clamping jaw set of the production installation in its working position.
Figure 4:
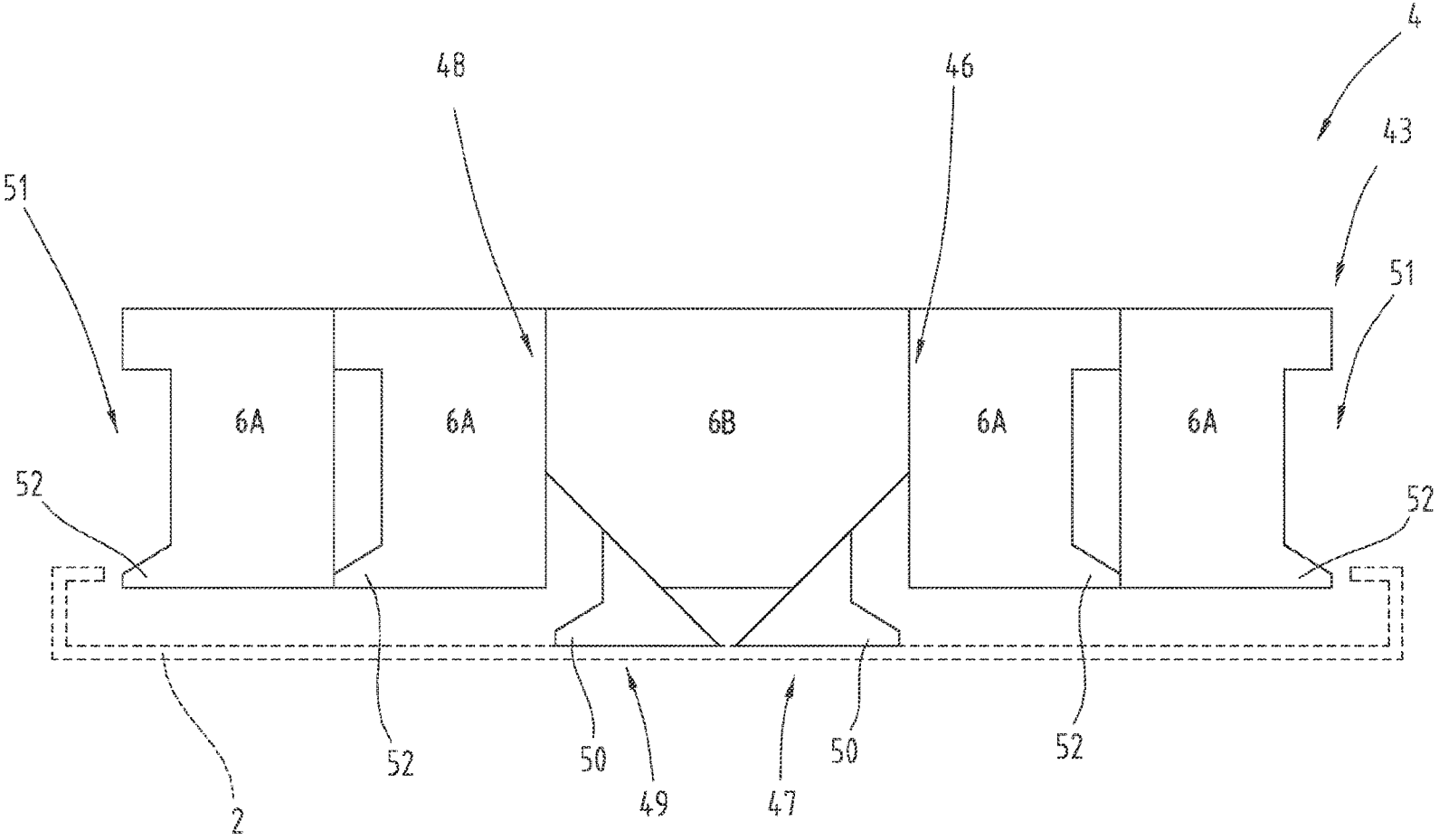
FIG. 4 a front view of the upper clamping jaw set according to FIG. 3 in its shortened pull-out position.
Figure 5:
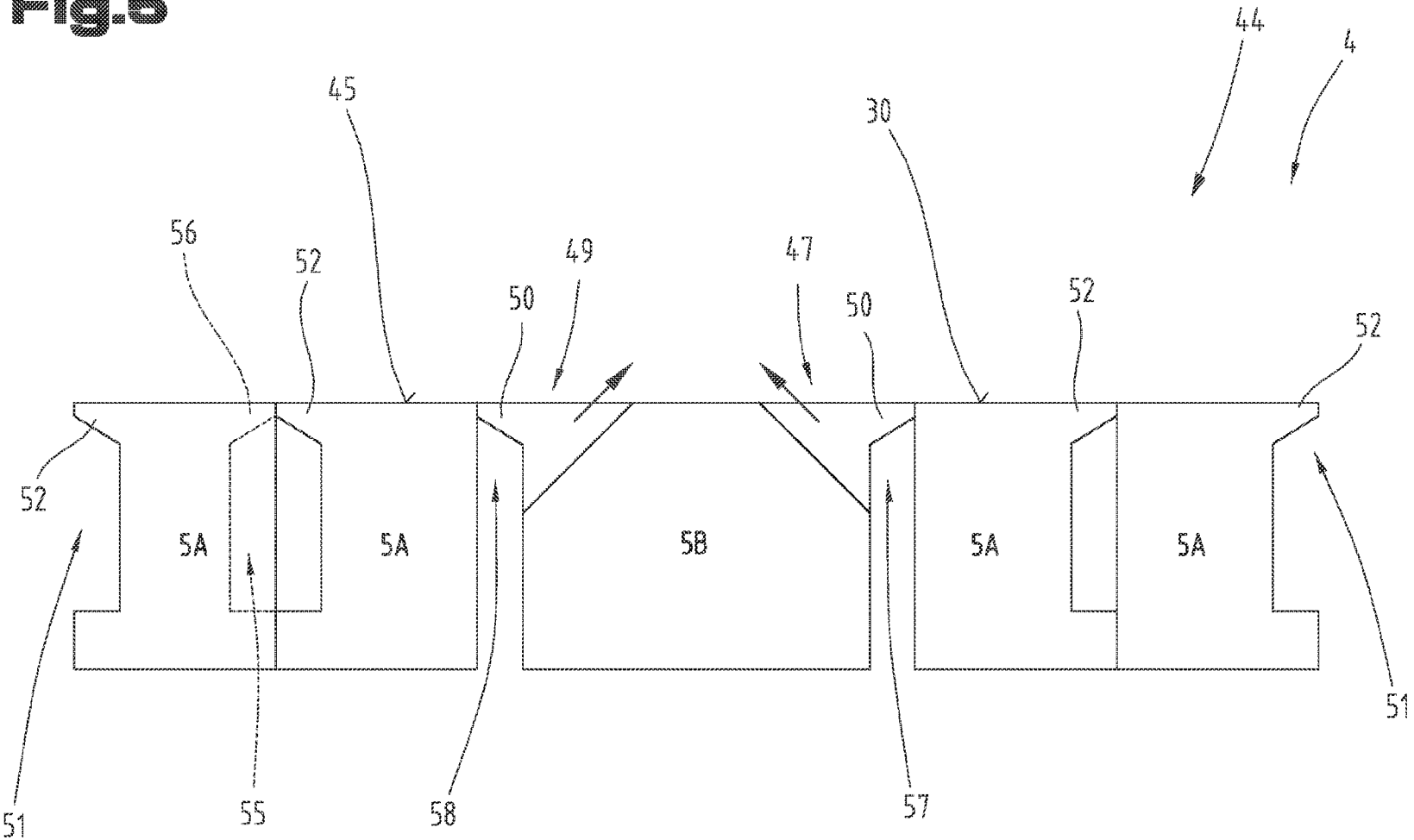
FIG. 5 a front view of a possible alternative embodiment of the lower clamping jaw set in its working position.

In FIGS. 3 and 4, solely the upper clamping jaw set 43 is depicted based on the representations in FIGS. 1 and 2. It comprises the at least one second upper clamping jaw 6B with the clamping jaw parts 47, 49 respectively adjustably arranged on the sides of its base body. The clamping jaw parts 47, 49 are depicted in the working position in FIG. 3. Respectively laterally adjacent thereto and adjoining thereto, two pieces of first upper clamping jaws 6A are arranged per side. Preferably, merely one piece of second upper clamping jaw 6B is used in an upper clamping jaw set 43. Thus, the second upper clamping jaw 6B may always be arranged stationarily in relation to the upper clamping beam 16.

In this arrangement, the at least one second upper clamping jaw 6B is arranged in a central region of the upper clamping jaw set 43. It may further be provided for that the at least one second upper clamping jaw 6B of the upper clamping jaw set 43 is arranged on a stationary position in relation to the upper clamping beam 16. This has the advantage that when adjusting the total length of the bending edge 45 required for the bending operation, the second upper clamping jaw 6B may always remain stationary and merely the first upper clamping jaws 6A respectively located laterally adjacent thereto are to be arranged in the respectively required length and number. Due to the central and stationary arrangement of the second upper clamping jaw 6B, the supply of the second upper clamping jaw 6B with energy for performing the adjusting operation of the clamping jaw parts 47, 49 from the working position in the pull-out position and vice very may be provided for easier on the bending machine 3.

Hence, the number of upper clamping jaws 6A, 6B of the upper clamping jaw set 43 may be selected such that in the working position, a total length of the bending edge 45 corresponds to a sum, said sum being composed of the individual lengths of the first partial bending edges 53 of the first upper clamping jaws 6A plus the length of the second partial bending edge 54 of the second upper clamping jaw 6B. The thus composed sum at the maximum corresponds to a longitudinal dimension of the clamping length to be supported on the workpiece 2 to be manufactured or of the bend to be formed on the workpiece 2 to be manufactured. The workpiece 2 is indicated by dashed lines in the two FIGS. 3 and 4.

Due to the central and always positioned arrangement of the second upper clamping jaw 6B, the upper first clamping jaws 6A located laterally adjacent thereto may be easily provided in the number as well as their partial lengths corresponding to the clamping length as well as bending edge 45 to be formed and be composed as upper clamping jaw set 43 on the bending machine 3. This may be carried out by laterally moving and/or adding and/or removing first upper clamping jaws 6A.

For both of the outer upper first clamping jaws 6A it is further indicated in dashed lines that these may respectively comprise a second horn 56 projecting from the base body of the first upper clamping jaw 6A in the direction of the longitudinal extension of the clamping beams 13, 16 on the second end region 55 facing the at least one second upper clamping jaw B6. The second horn 56 may be provided on individual ones of the but also on all of the first upper clamping jaws 6A.

Moreover, the numbers of upper clamping jaws 6A, 6B of the upper clamping jaw set 43 are to be equal to one another in the working position and in the pull-out position.

In FIG. 4, the shortened pull-out position of the upper clamping jaw set 43 with the upper clamping jaws 6A, 6B is shown. The two clamping jaw parts 47, 49 arranged on the sides of the base body of the two upper clamping jaws 6B are moved relative to the base body such that the shortened outer longitudinal dimension of the upper clamping jaw set 43 may be achieved.

As now, a free space between the base bodies of the first upper clamping jaws 6A respectively located directly laterally adjacent to the second upper clamping jaw 6B is created, all first upper clamping jaws 6A respectively arranged adjacent thereto may be moved in the direction to the base body of the at least one second upper clamping jaw 6B.

Prior to performing these adjustment movements, the clamping effect between the upper and lower clamping jaws 5, 6 usually is to be released so as to not transfer a damage to the workpiece 2 from one of the clamping jaws 5, 6. For further adjustment, in particular lifting the upper clamping beam 16, the clamping jaw parts 47, 49 are to be adjusted from their working position to the pull-out position shortened for this purpose. To provide a better overview, the representation of guiding arrangements, possible adjustment drives as well as the energy supply of these was dispensed with. The first upper clamping jaws 6 A are also to be moved into these emerging free spaces formed laterally adjacent to the base body of the upper clamping jaw 6B into the direction of the second upper clamping jaw 6B. Thus, in the respective outermost edge regions of the upper clamping jaw set 43, a collision-free adjustment out of the workpiece 2 is allowed for.

It is also possible that the lower clamping jaw set 44 may be formed analogously and composed variably, as was described above with respect to the upper clamping jaw set 43. This is shown in simplified form in FIG. 5.

The clamping tool 4 then further comprises the lower clamping jaw set 44. The lower clamping jaw set 44 comprises several first lower clamping jaws 5A and at least one second lower clamping jaw 5B. The at least one second lower clamping jaw 5B respectively comprises a first and second clamping jaw part 47, 49 movable form the working position in the pull-out position on both sides on the first and second end sections 57, 58 arranged in the direction of the longitudinal extension of the clamping beams 13, 16. The clamping jaw parts 47, 49 may be formed equal to the clamping jaw parts described above.

Here too, at least one first lower clamping jaw 5A is respectively arranged on both sides of the at least one second lower clamping jaw 5B in the direction of the longitudinal extension of the clamping beams 13, 16. The first horn 52 described above as well as, if applicable, also the second horn 56 may also be provided again.

The adjustment of the clamping jaw parts 47, 49 may be carried out by means of methods and techniques known from the prior art. Hence, a combined axial adjustment and swiveling movement could be carried out. However, a linear oblique adjustment as indicated by arrows in FIG. 3 is also conceivable.

By common actuation of the clamping jaw parts 47, 49 and the preferred sliding movement of the first clamping jaws 5A, 6A, which all have the rigid horn 52, it is also possible to thread out from a box although the second clamping jaw 5B, 6B with the mobile clamping jaw parts 47, 49 is located in the central position as a horn tool. The first clamping jaws 5A, 6A are preferably formed as standard tools.

The clamping jaw parts 47, 49 with the horns or projections 50 are located in a central position with the respective second clamping jaw 5B, 6B and may be directly supplied with energy there due to no and/or just a short change of position. It is thus possible to provide the second clamping jaws 5B, 6B with an actuation which may cope without a tool changer.

The first clamping jaws 5A, 6A, in particular the ones of the upper clamping jaw set 43, which are involved in the clamping and are thus arranged within the workpiece 2 formed as a box, are to be moved to the inside commonly with the upward movement of the clamping beam 16 and the actuation of the second clamping beam 5B, 6B.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

Finally, as a matter of form, it should be noted that for ease of understanding of the structure, elements are partially not depicted to scale and/or are enlarged and/or are reduced in size.

| List of reference numbers | |
|---|---|
| 1 | manufacturing plant |
| 2 | workpiece |
| 3 | bending machine |
| 4 | clamping tool |
| 5 | lower clamping jaw |
| 6 | upper clamping jaw |

-continued

| List of reference numbers | |
|---|---|
| 7 | machine frame |
| 8 | base plate |
| 9 | side wall |
| 10 | side wall |
| 11 | cross connection |
| 12 | front face |
| 13 | lower clamping beam |
| 14 | front end face |
| 15 | clamping beam guide |
| 16 | upper clamping beam |
| 17 | end face |
| 18 | end face |
| 19 | clamping jaw mount |
| 20 | clamping jaw mount |
| 21 | driving arrangement |
| 22 | driving means |
| 23 | energy grid |
| 24 | controller |
| 25 | input terminal |
| 26 | spindle drive |
| 27 | adjusting means |
| 28 | machine plane |
| 29 | clamping region |
| 30 | lower clamping surface |
| 31 | upper clamping surface |
| 32 | support table |
| 33 | support plane |
| 34 | bending region |
| 35 | bending unit |
| 36 | workpiece supporting plane |
| 37 | bending tool |
| 38 | bending beam |
| 39 | manipulation apparatus |
| 40 | manipulator |
| 41 | holding element |
| 42 | working edge |
| 43 | upper clamping jaw set |
| 44 | lower clamping jaw set |
| 45 | bending edge |
| 46 | first end section |
| 47 | first clamping jaw part |
| 48 | second end section |
| 49 | second clamping jaw part |
| 50 | projection |
| 51 | first end region |
| 52 | first horn |
| 53 | first partial bending edge |
| 54 | second partial bending edge |
| 55 | second end region |
| 56 | second horn |
| 57 | first end section |
| 58 | second end section |

The invention claimed is:

1. A production installation for producing workpieces from sheet metal by forming in a bending operation, comprising:

a bending machined with a fixed machine frame, a lower clamping beam and with an upper clamping beam, wherein at least one of the clamping beams is adjustable relative to the machine frame in order to clampingly hold the workpiece to be manufactured, a clamping tool with at least one lower clamping jaw and with an upper clamping jaw set from comprising several first upper clamping jaws and at least one second upper clamping jaw, and each of the at least one lower clamping jaw, the first upper clamping jaws, and the at least one second upper clamping jaw comprising a base body, wherein the at least one lower clamping jaw is held on the lower clamping beam and the first upper clamping jaws and the at least one second upper clamping jaw of the upper clamping jaw set are held on the upper clamping beam, and wherein the at least one second upper clamping jaw in a direction of a longitudinal extension of the clamping beams on a first end section comprises a first clamping jaw part movable relative to its base body from a working position to a pull-out position, wherein a longitudinal extension of the upper clamping jaw set is shorter in the pull-out position than in the working position, and wherein a bending edge aligned in the direction of the longitudinal extension of the clamping beams is formed by the upper clamping jaw set when the first upper clamping jaws are in the working position, and a first partial bending edge of the bending edge is respectively formed by each first upper clamping jaw as well as a second partial bending edge is formed by the at least one second upper clamping jaw in the working position, and a bending unit, said bending unit being adjustable relative to the clamping tool for performing a bending operation, wherein the at least one second upper clamping jaw further comprises a second clamping jaw part movable relative to its base body from the working position in the pull-out position on its second end section arranged at a distance from the first end section in the direction of the longitudinal extension of the clamping beams, at least one first upper clamping jaw is respectively arranged on both sides of the at least one second upper clamping jaw in the direction of the longitudinal extension of the clamping beams, and wherein the first upper clamping jaws respectively comprise a first horn at least on their first end regions facing away from the at least one second upper clamping jaw, said first horn being formed to project from the respective base body of the first upper clamping jaw in the direction of the longitudinal extension of the clamping beams.

2. The production installation according to claim 1, wherein the first and second clamping jaw parts are respectively formed with a horn-shaped projection, and wherein a shortened outer longitudinal dimension of the second upper clamping jaw in the direction of the longitudinal extension of the clamping beams is defined by the first and second clamping jaw parts in the pull-out position.

3. The production installation according to claim 2, wherein the shortened outer longitudinal dimension of the second upper clamping jaw in the pull-out position corresponds to a maximum length of the base body of the second upper clamping jaw.

4. The production installation according to claim 1, wherein in the pull-out position, the first upper clamping jaws that are respectively arranged on both sides of the at least one second upper clamping jaw are respectively moved in a direction of the base body of the at least one second upper clamping jaw.

5. The production installation according to claim 1, wherein at least individual ones of the first upper clamping jaws respectively comprise a second horn projecting from the base body in the direction of the longitudinal extension of the clamping beams on their second end regions facing the at least one second upper clamping jaw.

6. The production installation according to claim 1, wherein the at least one second upper clamping jaw of the upper clamping jaw set is arranged on a stationary position in relation to the upper clamping beam.

7. The production installation according to claim 1, wherein the at least one second upper clamping jaw is arranged in a central region of the upper clamping jaw set.

8. The production installation according to claim 1, wherein a number of upper clamping jaws of the upper clamping jaw set is selected such that in the working position, a total length of the bending edge corresponds to a sum, said sum being composed of individual lengths of the first partial bending edges of the first upper clamping jaws plus a length of the second partial bending edge of the second upper clamping jaw, and the sum at a maximum corresponds to a longitudinal dimension of a clamping length to be supported on the workpiece to be manufactured.

9. The production installation according to claim 1, wherein a number of upper clamping jaws of the upper clamping jaw set in the working position is equal to a number of upper clamping jaws of the upper clamping jaw set in the pull-out position.

10. The production installation according to claim 1, wherein the clamping tool further comprises a lower clamping jaw set and the lower clamping jaw set comprises several first lower clamping jaws and at least one second lower clamping jaw, and wherein the at least one second lower clamping jaw respectively comprises a first and second clamping jaw part movable from the working position in the pull-out position on both sides on its first and second end sections arranged in the direction of the longitudinal extension of the clamping beams.

11. The production installation according to claim 10, wherein at least one first lower clamping jaw is respectively arranged on both sides of the at least one second lower clamping jaw in the direction of the longitudinal extension of the clamping beams.

12. A method for adjusting a total length of a bending edge of a clamping jaw set of a clamping tool of a production installation for producing workpieces from sheet metal forming in a bending operation, wherein the method comprises the following steps:

providing a bending machine with a fixed machine frame, a lower clamping beam and with an upper clamping beam, wherein at least one of the clamping beams is adjustable relative to the machine frame in order to clampingly hold the workpiece to be manufactured, providing a clamping tool comprising at least one lower clamping jaw and an upper clamping jaw set with comprising several first upper clamping jaws and with at least one second upper clamping jaw, wherein each of the at least one lower clamping jaw, the first upper clamping jaws, and the at least one second upper clamping jaw comprises a base body, and wherein the at least one lower clamping jaw is held on the lower clamping beam and the first upper clamping jaws and the at least one second upper clamping jaw of the upper clamping jaw set are held on the upper clamping beam, and wherein the at least one second upper clamping jaw in a direction of a longitudinal extension of the clamping beams on a first end section comprises a first clamping jaw part movable relative to its base body from a working position to a pull-out position, wherein a longitudinal dimension of the upper clamping jaw set is formed to be shorter in the pull-out position than in the working position, and wherein a bending edge aligned in the direction of the longitudinal extension of the clamping beams is formed by the upper clamping jaw set when the upper clamping jaws are in the working position, and wherein a first partial bending edge of the bending edge is respectively formed by each first upper clamping jaw as well as a second partial bending edge is formed by the at least one second upper clamping jaw in the working position, and providing a bending unit, said bending unit being adjustable relative to the clamping tool for performing a bending operation, wherein the at least one second upper clamping jaw is further provided with a second clamping jaw part movable relative to its base body from the working position in the pull-out position on its second end section arranged at a distance from the first end section in the direction of the longitudinal extension of the clamping beams, at least one first upper clamping jaw is respectively arranged on both sides of the at least one second upper clamping jaw in the direction of the longitudinal extension of the clamping beams, and wherein the first upper clamping jaws are respectively provided with a first horn at least on their first end regions facing away from the at least one second upper clamping jaw, said first horn being formed to project from the base body of the first upper clamping jaw in the direction of the longitudinal extension of the clamping beams.

13. The method according to claim 12, wherein the first and second clamping jaw parts are respectively formed with a horn-shaped projection, and wherein a shortened outer longitudinal dimension of the second upper clamping jaw in the direction of the longitudinal extension of the clamping beams is defined by the first and second clamping jaw parts in the pull-out position.

14. The method according to claim 13, wherein the shortened outer longitudinal dimension of the second upper clamping jaw in the pull-out position corresponds to a maximum length of the base body of the second upper clamping jaw.

15. The method according to claim 12, wherein for the formation of the pull-out position, the first upper clamping jaws that are respectively arranged on both sides of the at least one second upper clamping jaw are respectively moved in the direction of the base body of the at least one second upper clamping jaw.

16. The method according to claim 12, wherein at least individual ones of the first upper clamping jaws are respectively provided with a second horn projecting from the base body in the direction of the longitudinal extension of the clamping beams on their second end regions facing the at least one second upper clamping jaw.

17. The method according to claim 12, wherein the at least one second upper clamping jaw of the upper clamping jaw set is arranged on a stationary position in relation to the upper clamping beam.

18. The method according to claim 12, wherein a number of upper clamping jaws of the upper clamping jaw set is selected such that in the working position, a total length of the bending edge corresponds to a sum, said sum being composed of individual lengths of the first partial bending edges of the first upper clamping jaws plus a length of the second partial bending edge of the second upper clamping jaw, and the sum at a maximum corresponds to a longitudinal dimension of a clamping length to be supported on the workpiece to be manufactured.

19. A production installation for producing workpieces from sheet metal by forming in a bending operation, comprising:

a bending machine with a fixed machine frame, a lower clamping beam and with an upper clamping beam, wherein at least one of the clamping beams is adjustable relative to the machine frame in order to clampingly hold the workpiece to be manufactured, a clamping tool with at least one lower clamping jaw and with an upper clamping jaw set comprising several first upper clamping jaws and at least one second upper clamping jaw, and each of the at least one lower clamping jaw, the first upper clamping jaws, and the at least one second upper clamping jaw comprising a base body, wherein the at least one lower clamping jaw is held on the lower clamping beam and the first upper clamping jaws and the at least one second upper clamping jaw of the upper clamping jaw set are held on the upper clamping beam, and wherein exclusively the at least one second upper clamping jaw in a direction of a longitudinal extension of the clamping beams on a first end section comprises a first clamping jaw part movable relative to its base body from a working position to a pull-out position, wherein a longitudinal extension of the upper clamping jaw set is shorter in the pull-out position than in the working position, and wherein a bending edge aligned in the direction of the longitudinal extension of the clamping beams is formed by the upper clamping jaw set when the first upper clamping jaws are in the working position, and a first partial bending edge of the bending edge is respectively formed by each first upper clamping jaw as well as a second partial bending edge is formed by the at least one second upper clamping jaw in the working position, and a bending unit, said bending unit being adjustable relative to the clamping tool for performing a bending operation, wherein exclusively the at least one second upper clamping jaw further comprises a second clamping jaw part movable relative to its base body from the working position in the pull-out position on its second end section arranged at a distance from the first end section in the direction of the longitudinal extension of the clamping beams, at least one first upper clamping jaw is respectively arranged on both sides of the at least one second upper clamping jaw in the direction of the longitudinal extension of the clamping beams, such that when the first clamping jaw part and the second clamping jaw part are in the working position, a free adjusting space is created between the respective first upper clamping jaw and the at least one second upper clamping jaw, and wherein the first upper clamping jaws respectively comprise a first horn at least on their first end regions facing away from the at least one second upper clamping jaw, said first horn being a one-piece unit with the respective base body and being formed to project from the respective base body of the first upper clamping jaw in the direction of the longitudinal extension of the clamping beams.

20. A production installation for producing workpieces from sheet metal by forming in a bending operation, comprising:

a bending machine with a fixed machine frame, a lower clamping beam and with an upper clamping beam, wherein at least one of the clamping beams is adjustable relative to the machine frame in order to clampingly hold the workpiece to be manufactured, a clamping tool with at least one lower clamping jaw and with an upper clamping jaw set comprising several first upper clamping jaws and at least one second upper clamping jaw, and each of the at least one lower clamping jaw, the first upper clamping jaws, and the at least one second upper clamping jaw comprising a base body, wherein the at least one lower clamping jaw is held on the lower clamping beam and the first upper clamping jaws and the at least one second upper clamping jaw of the upper clamping jaw set are held on the upper clamping beam, and wherein the at least one second upper clamping jaw in a direction of a longitudinal extension of the clamping beams on a first end section comprises a first clamping jaw part movable relative to its base body from a working position to a pull-out position, the first clamping jaw part not being removable from the at least one second upper clamping jaw when changing from the working position to the pull-out position, wherein a longitudinal extension of the upper clamping jaw set is shorter in the pull-out position than in the working position, and wherein a bending edge aligned in the direction of the longitudinal extension of the clamping beams is formed by the upper clamping jaw set when the first upper clamping jaws are in the working position, and a first partial bending edge of the bending edge is respectively formed by each first upper clamping jaw as well as a second partial bending edge is formed by the at least one second upper clamping jaw in the working position, and a bending unit, said bending unit being adjustable relative to the clamping tool for performing a bending operation, wherein the at least one second upper clamping jaw further comprises a second clamping jaw part movable relative to its base body from the working position in the pull-out position on its second end section arranged at a distance from the first end section in the direction of the longitudinal extension of the clamping beams, the second clamping jaw part not being removable from the at least one second upper clamping jaw when changing from the working position to the pull-out position, at least one first upper clamping jaw is respectively arranged on both sides of the at least one second upper clamping jaw in the direction of the longitudinal extension of the clamping beams, and wherein the first upper clamping jaws respectively comprise a first horn at least on their first end regions facing away from the at least one second upper clamping jaw, said first horn being a one-piece unit with the respective base body and being formed to project from the respective base body of the first upper clamping jaw in the direction of the longitudinal extension of the clamping beams.

* * * * *